US005760334A

United States Patent [19]

Ziemek

[11] Patent Number: 5,760,334

[45] Date of Patent: Jun. 2, 1998

[54] METALLIC SHEATH FOR AN ELECTRIC CABLE AND METHOD OF MAKING THE SAME

[75] Inventor: Gerhard Ziemek, Langenhagen, Germany

[73] Assignee: Alcatel Kabel AG & Co., Germany

[21] Appl. No.: 685,875

[22] Filed: Jul. 24, 1996

[51] Int. Cl.[6] ..... H01B 13/26; H01B 7/20

[52] U.S. Cl. ..... 174/28; 174/37; 174/102 D; 174/106 D; 29/828

[58] Field of Search ..... 29/828, 887; 174/28, 174/34, 37, 68.3, 99 R, 99 E, 102 R, 102 C, 102 D, 106 D; 428/34.1

[56] References Cited

U.S. PATENT DOCUMENTS

| | | | |
|---|---|---|---|
| 2,525,300 | 10/1950 | Jones | 174/102 D X |
| 2,817,363 | 12/1957 | Penrose | 174/102 D X |
| 2,870,792 | 1/1959 | Penrose | 174/102 D X |
| 2,964,090 | 12/1960 | Raydt et al. . | |
| 3,557,301 | 1/1971 | Priaroggia | 174/102 D |
| 3,582,536 | 6/1971 | Miller | 174/102 D |
| 3,656,331 | 4/1972 | Kuypers et al. . | |
| 3,694,617 | 9/1972 | Koch et al. . | |
| 3,754,094 | 8/1973 | Ziemek et al. | 174/102 D X |
| 3,766,645 | 10/1973 | Ziemek | 29/828 |
| 4,083,484 | 4/1978 | Polizzano et al. | 29/828 X |
| 4,297,526 | 10/1981 | Leuchs et al. | 174/102 D X |
| 4,304,713 | 12/1981 | Perelman | 29/828 X |
| 4,341,943 | 7/1982 | Nilsen . | |
| 4,376,229 | 3/1983 | Maul et al. | 174/102 D X |
| 4,398,058 | 8/1983 | Gerth et al. | 174/102 D X |
| 4,400,605 | 8/1983 | Shevakin et al. . | |
| 4,800,250 | 1/1989 | Watanabe et al. . | |
| 5,181,316 | 1/1993 | Pote et al. | 29/828 |
| 5,197,182 | 3/1993 | Mizuo | 29/828 |
| 5,325,693 | 7/1994 | Hoffmann et al. . | |
| 5,410,901 | 5/1995 | Robblee et al. | 29/828 X |

FOREIGN PATENT DOCUMENTS

| | | |
|---|---|---|
| 603527 | 8/1960 | Canada . |
| 1086314 | 8/1960 | Germany . |
| 1916357 | 6/1971 | Germany . |
| 44-15890 | 7/1969 | Japan . |
| 475779 | 11/1937 | United Kingdom . |
| 791513 | 3/1958 | United Kingdom . |
| 2163373 | 2/1986 | United Kingdom . |

*Primary Examiner*—Horace M. Culver

*Attorney, Agent, or Firm*—Ware, Fressola, Van Der Sluys & Adolphson LLP

[57] ABSTRACT

A metallic sheath for an electric cable with a ratio of inner diameter Di to outer diameter Do of at least 0.9, comprises a lengthwise welded, annularly or helically shaped corrugated tube whose wall thickness is in a range between 0.005 and 0.009 of the outer diameter, and where the distance p between two neighboring corrugation crests is in a range between 0.08 and 0.12 of the outer diameter. In addition, a method of making the above described electric cable is described.

14 Claims, 2 Drawing Sheets

METALLIC SHEATH FOR AN ELECTRIC CABLE AND METHOD OF MAKING THE SAME

BACKGROUND OF THE INVENTION

1.Technical Field

The invention concerns a metallic sheath for an electric cable made of copper, aluminum or steel or their alloys with a ratio of inner diameter Di to outer diameter Do of at least 0.9.

2.Description of the Prior Art

Metallic sheaths have been known for a long time as protection for electric cables. The metal sheath must protect the insulation against moisture, particularly in buried cables.

One form of a metallic sheath comprises a lead sheath, which is extruded over the insulation layer. The lead sheath provides fault current carrying capabilities and simplifies jointing of cables. The lead sheath protects the cable against moisture, but does not impair the flexibility of the cable. The wall thickness of the lead sheath is about 10% of the outer diameter. In the future, the lead sheath will be replaced by other metal sheaths with identical properties, for ecological reasons.

The corrugated sheath was developed as an alternative to the lead sheath. This is a lengthwise welded metal tube which is provided with a helically or annularly shaped corrugation after the welding. The corrugation gives the relatively thin-walled sheath greater strength, as well as better flexibility.

In the corrugated sheath process, a lengthwise incoming metal tape is formed into a tube by a forming tool, and the tube is lengthwise welded and corrugated. The metal strip is formed into a tube with a larger diameter than that of the cable core which is inserted into the formed tube, to prevent damage to the cable core from the electric arc of the welding process. During the corrugation, the cable core is gripped through the corrugation troughs that were produced during the corrugation process.

A corrugated metal sheath for electric cables is known from CA-PS 603 527, wherein the inner diameter Di of the corrugated tube is between 0.75 and 0.85 of the outer diameter Do of the corrugated tube. The distance between two neighboring corrugation crests is in a range of from 0.15 to 0.25 of the outer diameter Do and the wall thickness is in a range of from around 0.005 to 0.02 of the outer diameter Do. With these dimensional ratios, an optimum of flexibility, weight, crush resistance, etc. can be achieved.

The corrugation process is a process as described for example in DE-AS 1086314. A rotating corrugating disk ring, which is located in a rotationally driven corrugation head, rolls over the surface of the welded tube producing corrugations in the tube wall, because it is located eccentrically in the corrugation head. With this process, tubes with a ratio of less than 30 and more than 100 of outer diameter Do to wall thickness s can only be manufactured by means of special precautions.

SUMMARY OF THE INVENTION

An object of the present invention is to produce a metallic, corrugated sheath for an electric cable with a ratio of inner diameter Di to outer diameter Do of more than 0.90, which is sufficiently flexible and offers metallic protection without much increase in the cable diameter.

This object is fulfilled in that the sheath is made of a lengthwise welded corrugated metal tube, whose wall thickness s is in a range of from 0.005 to 0.009 of the outer diameter Do, and in which the distance p between two neighboring corrugation crests is in a range of from 0.08 to 0.12 of the outer diameter Do.

The significant advantage of the invention is that a cable equipped with the sheath according to the principle of the invention can be used to directly replace a lead-sheathed cable, since the corrugated sheath according to the principle of the invention is no larger than the analogous lead sheath.

A suitable selection of the sheath material, or a coating, protects the sheath against corrosion.

The cable sheath is very flexible and has outstanding crush resistance or transverse stability. By suitably selecting the corrugation distance and the corrugation depth for a specified outer diameter, the wall thickness s can be reduced down to a size which is necessary for the electrical characteristics.

The invention also concerns an electric power cable comprising a conductor, a conductor shield, a plastic-based insulation layer, an outer conductive layer and a metallic external sheath placed over the outer conductive layer.

In accordance with the invention, the cable sheath is a corrugated tube, whose ratio of inner diameter Di to outer diameter Do is greater than 0.90, whose wall thickness is in a range of from 0.005 to 0.009 of the outer diameter Do, and where the distance between two neighboring corrugation crests is in a range of from 0.08 to 0.12 of the outer diameter Do.

A copper alloy is used as the material for the cable sheath, which has an electric conductivity of 44% International Annealed Copper Standard (IACS) and thereby fulfills all the requirements in the electrical sense. The alloy must be easy to weld, so that high welding speeds are attained, and it must have good formability, so that the corrugations are easy to produce in the tube.

It can be an advantage for some applications if an external plastic jacket is placed over the metal sheath.

The invention will be fully understood when reference is made to the following detailed description taken in conjunction with the accompanying drawing.

DETAILED DESCRIPTION OF THE INVENTION

Figure 1:
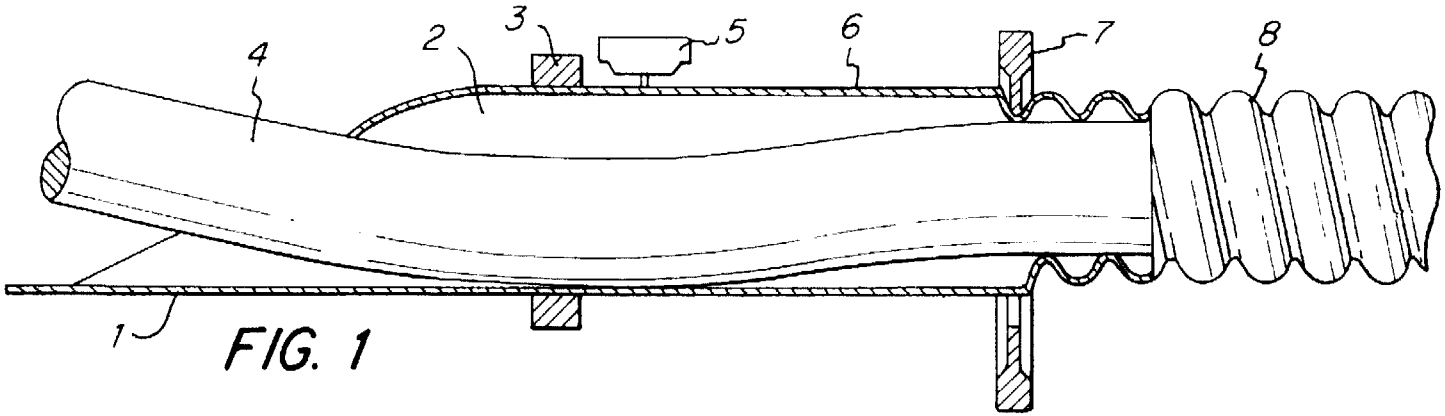
FIG. 1 is a schematic illustration of the manufacturing principle of corrugated tubes, where the type of corrugation is according to the state of the art.

A metal tape 1, which is drawn from a not illustrated storage spool, is formed into a slotted tube 2 by means of a forming tool 3. A cable core 4, which is drawn from an also not illustrated storage drum, is inserted into the still open slotted tube 2. The slotted tube 2 is manufactured with a diameter which allows enough of a gap to remain between the cable core 4 and the slot of the slotted tube, so that the cable core 4 does not suffer any damage when the slot is closed by welding—an arc welding or a laser welding installation 5. The welded tube 6 is then fed to a corrugating device 7 which produces a corrugated tube 8 from the smooth welded tube 6. The corrugation of the corrugated tube 8 is such, that the cable core 4 is gripped by the corrugation, i.e. the troughs of the corrugated tube 8 grip the cable core 4. Such a method is known in principle from DE-AS 1086314.

Figure 2:
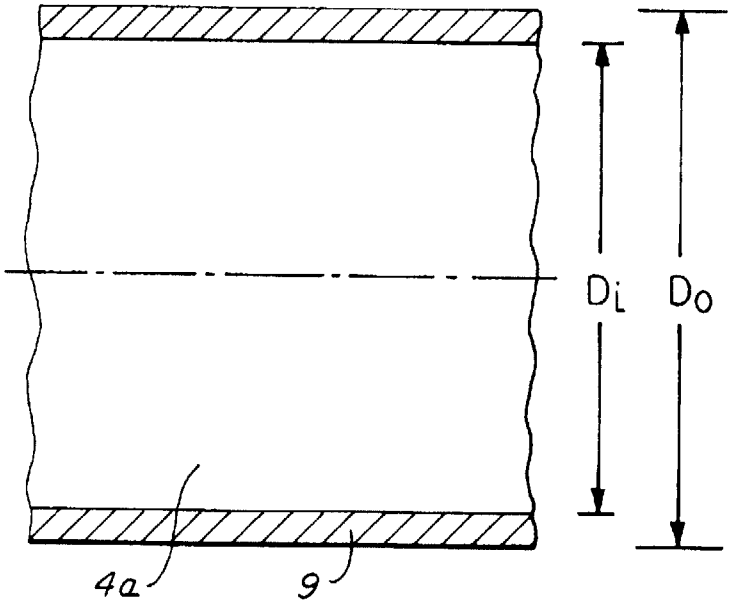
FIG. 2 (PRIOR ART)
FIG. 2 is a longitudinal cross-sectional view of a prior art cable having a lead sheath.

FIG. 2 illustrates a conventional cable with a cable core 4a, and a lead sheath 9 placed over the cable core 4a. The lead sheath 9 has an inner diameter Di and an outer diameter Do. The wall thickness of the lead sheath 9 is determined by the mechanical requirements and the necessary cross section for the fault current carrying capability of the cable. In conventional lead sheath cables, the wall thickness of the lead sheath 9 is between 5 and 10% of the lead sheath's outer diameter Do.

Figure 3:
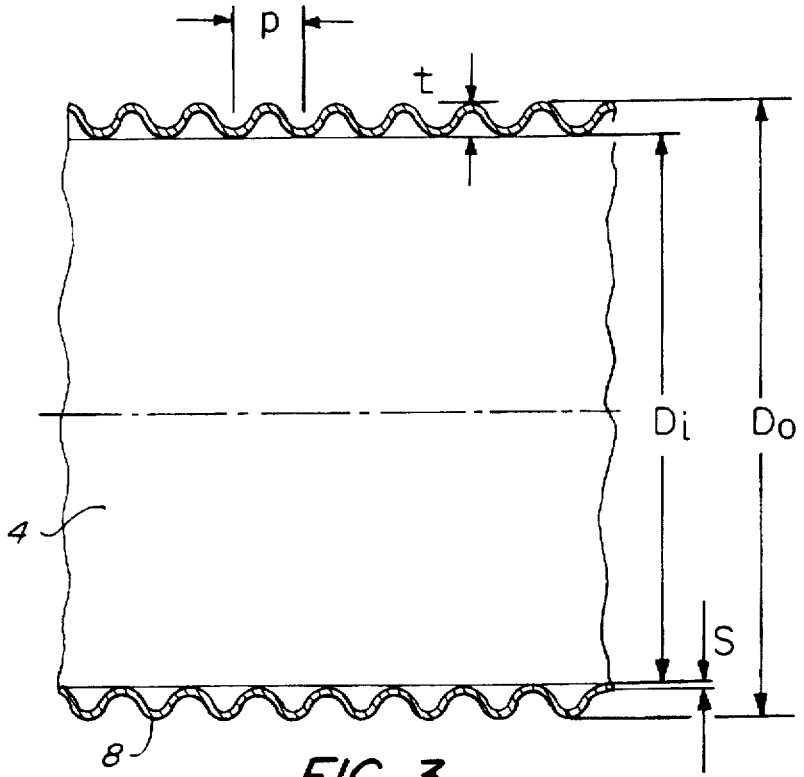
FIG. 3 is a longitudinal cross-sectional view of a cable of the present invention.

Turning to FIG. 3, the corrugation of the sheath 8 according to the principle of the invention is configured so that the outer diameter Do as well as the inner diameter Di correspond to the outer and inner diameters of the lead sheath 9, i.e. the sheath 8 replaces the lead sheath 9 without any need to change the geometrical dimensions. Therefore, like the known lead sheath, a cable equipped with the sheath 8 of the invention can be inserted into cable conduits, thus replacing the lead sheath used until now.

The electrical properties of the sheath 8 are obtained by using a material that is a copper alloy with 90% by weight of copper and 10% by weight of zinc, which has a conductivity of 44% IACS. The sheath 8 can also be made from an age-hardened alloy that is 1% to 2% by weight of manganese and 98% to 99% by weight of aluminum.

The mechanical strength of the sheath 8, particularly the stability and crush resistance, are achieved by using a significantly lower corrugation depth t and a significantly shorter corrugation pitch p (the distance between neighboring corrugation crests), as compared to known corrugated tubes, i.e. the number of corrugations per unit of length is significantly increased. This divides the forces acting on each corrugation crest of the known corrugated tube into many individual forces. This is achieved by increasing the corrugating rpm in proportion to the linear speed of the welded tube.

The table shows the dimensions of three cable sheaths made of the cited copper alloy:

| Do[mm] | Di[mm] | s[mm] | p[mm] | t[mm] |
|---|---|---|---|---|
| 72.5 | 67.2 | 0.5 | 7.1 | 2.15 |
| 58.65 | 53.85 | 0.5 | 6.2 | 1.9 |
| 39.50 | 35.6 | 0.35 | 4.6 | 1.62 |

Figure 4:
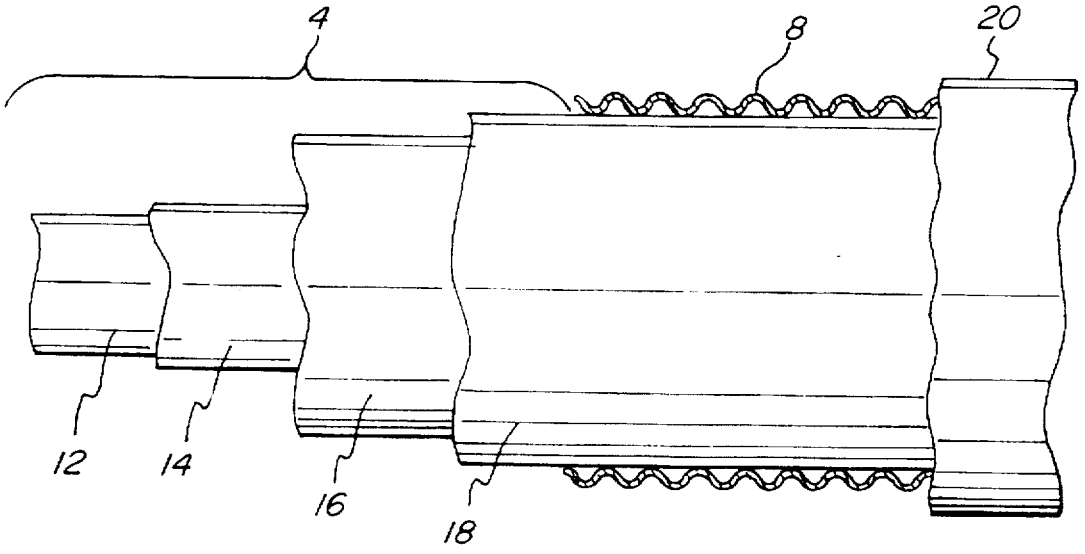
FIG. 4 is a cut-away view of an electric power cable made in accordance with the present invention.

Turning to FIG. 4, the cable core 4 is shown as comprising a conductor 12, inner conductor shield 14 (semi-conductive extruded polymeric material), insulation layer 16 (extruded polymeric material, e.g., cross-linked polyethylene) and extruded semi-conducting polymeric shield layer 18. The corrugated metal sheath 8 surrounds the core 4. The electric power cable of FIG. 4 is completed by extruding an extruded polymeric jacket 20 over the corrugated metal sheath 8.

The preferred embodiment described above admirably achieves the objects of the invention. However, it will be appreciated that departures can be made by those skilled in the art without departing from the spirit and scope of the invention which is limited only by the following claims.

What is claimed is:

1. A metallic sheath for an electric cable, which comprises a corrugated metal tube having:

(a) a ratio of inner diameter to outer diameter of more than 0.90;

(b) a wall thickness in a range of from 0.005 to 0.09 of the outer diameter; and (c) a corrugation pitch in a range of from 0.08 to 0.12 of the outer diameter.

2. A metallic sheath as claimed in claim 1, further having a corrugation depth in a range of from 0.01 to 0.08 of the outer diameter.

3. A metallic sheath as claimed in claim 1, wherein the ratio of the outer diameter and the wall thickness is over 100.

4. A metallic sheath as claimed in claim 1, wherein the tube is made from an age-hardened manganese-aluminum alloy.

5. A metallic sheath as claimed in claim 4, wherein the manganese-aluminum alloy is between 1% and 2% manganese and 98% and 99% aluminum.

6. In an electric power cable with a conductor, conductor shield, a layer of plastic insulation, a conductive outer layer placed over the plastic layer, and a metallic cable sheath which is applied to the conductive outer layer, the improvement comprising the cable sheath is a corrugated tube having:

(a) a ratio of inner diameter to outer diameter of more than 0.90;

(b) a wall thickness in a range of from 0.005 to 0.09 of the outer diameter; and (c) a corrugation pitch in a range of from 0.08 to 0.12 of the outer diameter.

7. An electric power cable as claimed in claim 6, further including a plastic external jacket placed over the corrugated tube.

8. An electric power cable as claimed in claim 6, wherein the bending radius of the cable is smaller than nine times the outer diameter.

9. An electric power cable as claimed in claim 6, wherein the tube is made from an age-hardened manganese-aluminum alloy.

10. An electric power cable as claimed in claim 9, wherein the manganese-aluminum alloy is between 1% and 2% manganese and 98% and 99% aluminum.

11. An electric power cable as claimed in claim 6, further having a corrugation depth in a range of from 0.01 to 0.08 of the outer diameter.

12. A method for producing an electric power cable, which comprises the steps of:

(a) drawing a metal tape from a storage spool;

(b) forming the metal tape into a tube with a lengthwise slot;

(c) drawing a cable core from a storage drum;

(d) inserting the cable core into the lengthwise slotted tube, where the inner diameter of the lengthwise slotted tube is larger than the outer diameter of the cable core;

(e) welding the lengthwise slotted tube to close the slot and form a welded tube; and (f) corrugating the welded tube to form a corrugated tube with troughs of the corrugated tube gripping the cable core, the corrugated tube having the following parameters:

(i) inner diameter/outer diameter $\geqq 0.90$;

(ii) wall thickness is in a range of from 0.005 and 0.009 of the outer diameter; and (iii) corrugation pitch in a range of from 0.08 to 0.12 of the outer diameter.

13. A method as claimed in claim 12, further including the step of extruding a plastic external jacket over the corrugated tube.

14. A method as claimed in claim 12, wherein the corrugated tube is over 15% shorter than the welded tube from which it is made.

* * * * *